US010383472B2

(12) United States Patent
Hearne

(10) Patent No.: US 10,383,472 B2
(45) Date of Patent: Aug. 20, 2019

(54) PACKAGE SECURITY DEVICE

(71) Applicant: Christopher Hearne, Indianapolis, IN (US)

(72) Inventor: Christopher Hearne, Indianapolis, IN (US)

( * ) Notice: Subject to any disclaimer, the term of this patent is extended or adjusted under 35 U.S.C. 154(b) by 7 days.

(21) Appl. No.: 15/956,349

(22) Filed: Apr. 18, 2018

(65) Prior Publication Data

US 2018/0303265 A1 Oct. 25, 2018

Related U.S. Application Data

(60) Provisional application No. 62/487,322, filed on Apr. 19, 2017.

(51) Int. Cl.
*A47G 29/22* (2006.01)
*A47G 29/12* (2006.01)
*A47G 29/124* (2006.01)

(52) U.S. Cl.
CPC ..... *A47G 29/22* (2013.01); *A47G 29/1248* (2017.08); *A47G 29/12095* (2017.08)

(58) Field of Classification Search
CPC ..... A47G 29/22; A47G 29/12095; A47G 29/124; A47G 29/1248; A47G 29/20; A47G 29/1251; A47G 29/1254
USPC ..... 232/47, 45, 19, 17
See application file for complete search history.

(56) References Cited

U.S. PATENT DOCUMENTS 5,435,484 A * 7/1995 Carlson ..... A47G 29/1251 232/47
7,114,645 B2 * 10/2006 Felice ..... A47G 29/1207 232/31
7,175,071 B1 * 2/2007 Slagle ..... A47G 29/16 220/833
7,428,980 B2 9/2008 Irwin et al.
8,573,473 B1 * 11/2013 Farentinos ..... A47G 29/22 232/45
9,717,359 B2 * 8/2017 Bolles ..... A47G 29/22
2003/0226884 A1 * 12/2003 Swider ..... A47G 29/1207 232/26
2010/0127063 A1 * 5/2010 Bolles ..... A47G 29/22 232/39
2014/0131431 A1 * 5/2014 Silke ..... A47G 29/22 232/30

* cited by examiner

*Primary Examiner* — William L Miller
(74) *Attorney, Agent, or Firm* — Brannon Sowers & Cracraft

(57) ABSTRACT

A package security device includes a body having a plurality of sides, including a top side. The body further includes a storage chamber having a first chamber opening and a second chamber opening, and a receiving conduit that extends between a package opening and the second chamber opening. A package hatch is coupled with the top side and movable between an open position and a closed position blocking the package opening. A downwardly sloping chute forms a floor of the receiving conduit to facilitate gravity feeding of packages to the storage chamber. The device also includes a lockable first chamber hatch blocking the first chamber opening, and a second chamber hatch that opens in a direction opposite the package hatch, and that blocks the second chamber opening.

19 Claims, 3 Drawing Sheets

PACKAGE SECURITY DEVICE

CROSS-REFERENCE

This application claims the benefit of U.S. Provisional Patent Application No. 62/487,322 titled "PACKAGE SECURITY DEVICE," to Christopher Hearne, filed Apr. 19, 2017, the entire disclosure of which is expressly incorporated by reference herein.

TECHNICAL FIELD

The present disclosure relates generally to storage of parcels and, more particularly, to devices for securing delivered packages.

BACKGROUND

E-commerce has steadily grown in recent years, accounting for over 8% of all retail sales in 2016 with projections indicating this trend will continue to accelerate in the years to come. This increase has seen a corresponding rise in retailers' use of parcel delivery services such as the United States Post Office, UPS, FedEx, and others to deliver goods to their customers. Unfortunately, incidences of package theft have also seen sharp increases that correspond with the growing prevalence of online shopping and the delivery infrastructure supporting it. Studies indicate that around 11 million homes are victimized by so-called "package pirates" every year. Package theft is frequently described as a crime of opportunity. Packages are often left unattended by couriers and in plain view of passersby, thereby providing the opportunity for potential thieves to spot and intercept the delivery. There is rarely a substantial risk in investigating or taking unattended packages, and the reward can be quite lucrative. In many instances, packages are left at customers' residences while they are at work, school, or even on vacation, leaving the delivered package unattended for extended periods of time. With nearly three quarters of reported package thefts occurring when the victim was not home, securing unattended packages is an important package theft prevention strategy. As e-commerce is primed to continue to grow in popularity for the foreseeable future, effective, cost efficient, and aesthetically pleasing strategies for securing unattended packages will become increasingly important.

One such strategy is disclosed in U.S. Pat. No. 7,428,980 to Irwin et al. ("Irwin"). Irwin discloses a parcel collection device structured to receive and secure packages in a package container in a manner similar to parcel drop boxes used by most parcel couriers. Packages are inserted into a parcel drop, which is structured to rotate about a horizontal axis using a variety of weights, levers, and other components. Upon rotating the parcel drop, any package therein apparently drops into the package container, which can be locked to prevent unauthorized access. While this and other solutions may prevent the theft of some packages, improved and/or alternative strategies for securing packages left at residences remain desirable.

SUMMARY OF THE INVENTION

In one aspect, a device for receiving packages includes a body having a top side that has a package hatch movable to open or close a package opening, a storage chamber having a chamber opening, and a receiving conduit extending between the storage chamber and the package opening, with the storage chamber and the receiving conduit each being partially formed by the top side. The device further includes a chamber hatch coupled with the top side that blocks the chamber opening, and a downward sloping chute that forms a floor of the receiving conduit for conveying packages to the storage chamber under the force of gravity.

In another aspect, a bench for receiving packages includes a body having a receiving conduit, a storage chamber that includes a first chamber opening and a second chamber opening, and a plurality of sides, including a top side. The bench also includes a package hatch movable between an open position and a closed position blocking a package opening, and a downward sloping chute forming a floor of the receiving conduit, the receiving conduit extending between the package opening and the second chamber opening. Finally, the bench includes a first chamber hatch coupled with the top side and movable between an open position and a closed position blocking the first chamber opening, and a second chamber hatch coupled with the top side and movable between an open position and a closed position blocking a line of sight between the package opening and the storage chamber.

In still another aspect, a device for securing package deliveries includes a body having a plurality of sides arranged in a box configuration, the plurality of sides including a top side, a storage chamber having a first chamber opening formed in the top side and a second chamber opening, a first chamber hatch coupled with the top side and movable between an open position and a closed position for blocking the first chamber opening, and a second chamber hatch coupled with the top side and movable between an open position and a closed position blocking the second chamber opening. The device also includes a receiving conduit extending between the second chamber opening and a package opening formed in the top side, a package hatch coupled with the top side and movable between an open position and a closed position blocking the package opening, and a downward sloping chute partially forming a floor of the receiving conduit to facilitate conveying packages from the receiving conduit to the storage chamber.

DETAILED DESCRIPTION

Figure 1:
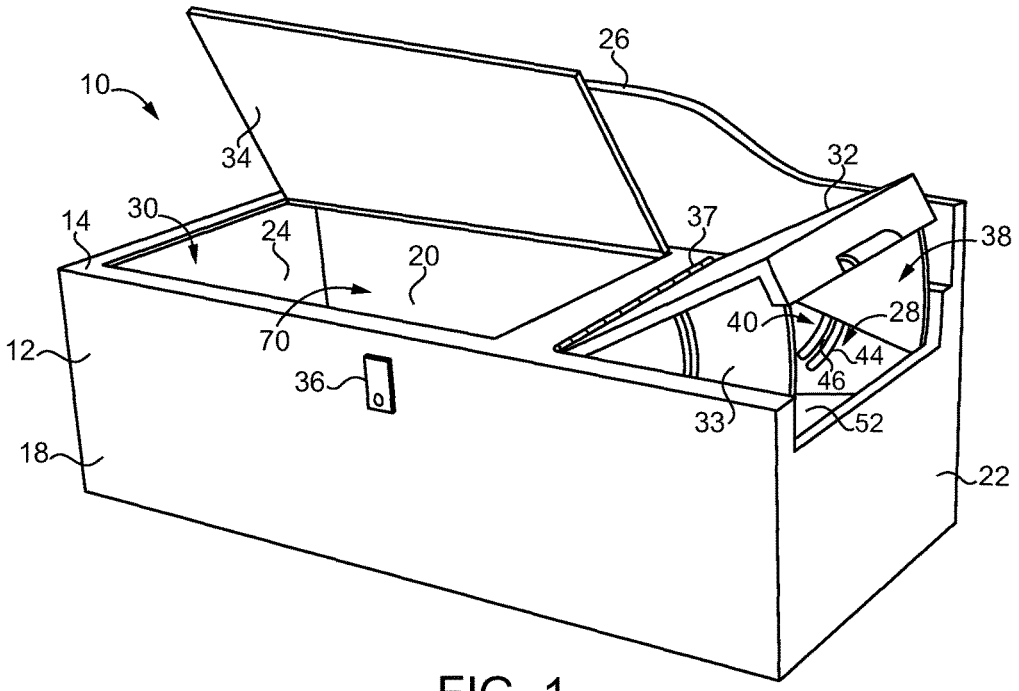
FIG. 1 is a diagrammatic perspective view of a device for receiving packages, according to one embodiment.
Figure 2:
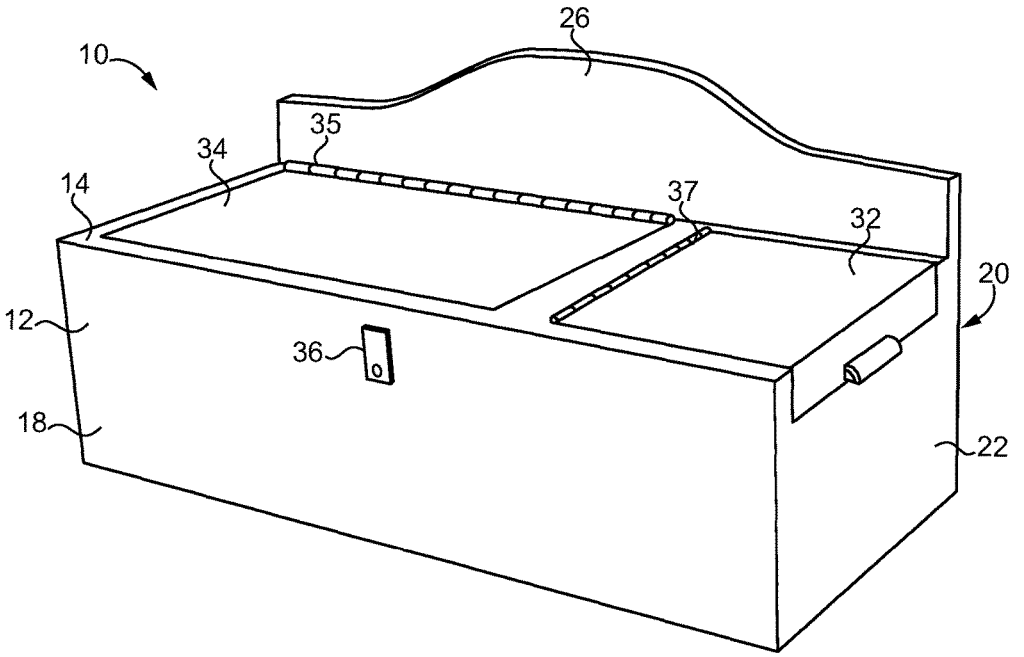
FIG. 2 is a diagrammatic perspective view of a device for receiving packages, according to one embodiment.

Referring now to FIGS. 1 and 2, perspective views of a device for receiving packages ("device") 10, which includes a bench, are shown. Device 10 includes a body 12 formed of a plurality of sides, including a top side 14, a bottom side 16, a front side 18, a back side 20, a right side 22, and a left side 24. The terms "top" and "bottom," "right" and "left," and "front" and "back" are used herein in a relative sense, each in relation to each other when viewing device 10, and should not necessarily be taken to mean that device 10 has a particular orientation. The plurality of sides 14, 16, 18, 20, 22, 24 generally are arranged in a box configuration, with a storage chamber 30 and a receiving conduit 28 being formed therein. Top side 14 includes a package hatch 32 pivotally coupled thereto, and movable between an open position (FIG. 1) and a closed position (FIG. 2). In the open position, package hatch 32 at least partially forms a package opening 38 sized and shaped to receive delivered packages. Top side 14 may also include a first chamber opening 70 for accessing storage chamber 30, and a first chamber hatch 34 coupled with top side 14 in a manner that permits first chamber hatch 34 to be movable between an open position (FIG. 1) and a closed position (FIG. 2) that blocks first chamber opening 70. In other embodiments, first chamber opening 70 and first chamber hatch 34 might be positioned at another location on body 12.

Device 10 includes a lock 36 to engage first chamber hatch 34 in a manner that can restrict access to first chamber opening 70 so as to prevent unauthorized access to storage chamber 30. In other words, lock 36 may interact with first chamber hatch 34 such that first chamber hatch 34 is not freely movable between the open and closed positions. Device 10 typically includes only a single lock 36, meaning device 10 has no more than one lock 36. As such, access to receiving conduit 28 via package opening 38, and access to storage chamber 30 via second chamber opening 56 is typically unrestricted for all users, although a degree to which package hatch 32 may be opened might be limited by a slide assembly 40 or other analogous mechanism. In some embodiments, however, hatches 32 or 54 may also be engaged by a lock 36 to restrict access to openings 38 or 56, respectively. Lock 36 includes a key actuated tumbler locking mechanism, though in other embodiments lock 36 may engage access hatch 34 through use of any other suitable mechanical or non-mechanical locking mechanism, and may be activated or deactivated through use of a keypad, dial, fingerprint, wireless signal, or any other authentication method or device. In still other embodiments, lock 36 may include a latch structured to receive a padlock or other suitable type of lock.

It has been observed that, as package theft is often a crime of opportunity, strategies that limit that opportunity may be effective in deterring such forms of theft. As such, device 10 may be disguised to have the appearance of—and may perhaps even be functional as—ordinary furniture to prevent drawing the attention of package thieves. Device 10 might therefore include features that may limit the opportunity for thieves to discover or gain possession of delivered packages. For example, device 10 may be structured to have the appearance of a bench and include a back piece 26 positioned at least partially above and oriented substantially parallel to top side 14. In this way, device 10 may not appear out of place on a user's porch, deck, patio, or the like. In other embodiments, device 10 may be structured to have the appearance of a couch, chair, loveseat, swing, planter, or any other piece of other furniture or other object, and therefore might include other features such as arm rests, cushions, or legs. Device 10 can also be configured to have a variety of different aesthetic profiles such that device 10 can match different color pallets, decorations, pieces of furniture, or the like.

Figure 3:
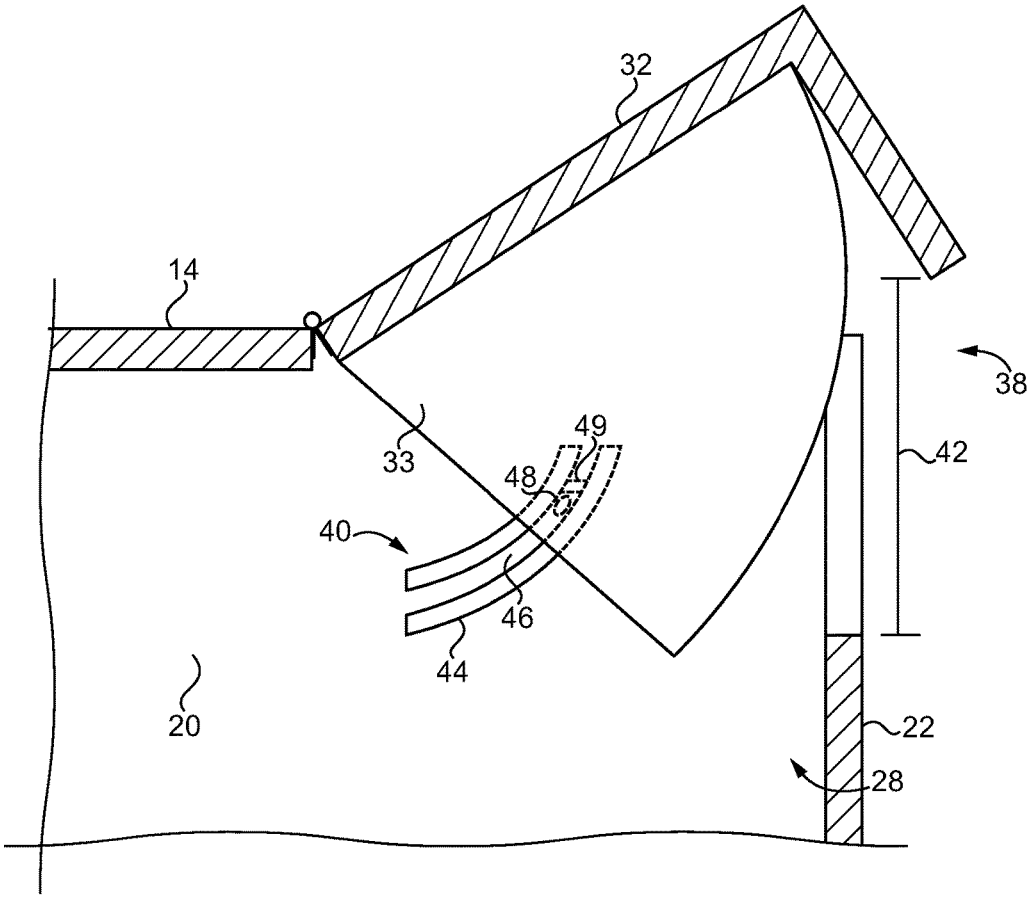
FIG. 3 is a partially sectioned diagrammatic view of a package hatch of a device for receiving packages, according to one embodiment.

First chamber hatch 34 and package hatch 32 are coupled with top side 14 by a first chamber hinge 35 and a package hinge 37, respectively. Hinges 35, 37 could be, for example, butt hinges, T-hinges, or any other suitable type of hinges. Package hinge 37 and first chamber hinge 35 define axes of rotation for package hatch 32 and first chamber hatch 34, respectively. Package hatch 32 may also include side guards 33 defining a lateral dimension (i.e., a width) of package opening 38 when package hatch 32 is in the open position. Side guards 33 can be positioned on opposite sides and extend downward from package hatch 32, and may include or be coupled with a mechanism that can limit a range of motion of package hatch 32 around the axis of rotation defined by package hinge 37. For instance, referring now also to FIG. 3, an exemplary embodiment may include slide assembly 40, which may be structured to limit counterclockwise movement of package hatch 32 around package hinge 37, thereby limiting a vertical dimension 42 of package opening 38, which includes a height (hereinafter "height 42"). Slide assembly 40 may include a slide track 44 defining a slide path 46, and a pin 48, with slide track 44 being attached to body 12 and pin 48 being attached to side guard 33, for instance. Opening package hatch 32 may thus result in pin 48 sliding upward within slide path 46 until reaching a slide stop 49, which is structured to halt the upward movement of pin 48 and, therefore, of package hatch 32. In some embodiments, package hatch 32 may not include side guards 33, or device 10 might be structured to limit height 42 by other means, such as using a chain, piston, or actuator. In still other embodiments, height 42 might not be limited at all. In a practical implementation strategy, package hatch 32 and slide assembly 40 may be structured to fix a maximum height 42 of package opening 38 that corresponds with a maximum dimension of packages typically received by device 10 or that might otherwise be expected to be received by device 10. While packages come in a virtually unlimited number of dimensional configurations, it has been observed that many of the most popular retailers and courier services typically choose from a limited number of predefined package sizes when packaging and shipping goods. As such, height 42 or any other dimension of package opening 38 (e.g., a width) might be limited in a manner that allows package opening 38 to accommodate these common package shapes and sizes. By way of example, height 42 might be limited to about 10 inches, and a width of package opening 38 between side guards 33 might be limited to about 20 inches. As will be apparent from the discussion herein, one or more dimensions of other components of device 10 may also be selected or structured to correspond with a dimension of packages expected to be received by device 10. It will be appreciated that, in certain embodiments, device 10 might be structured to receive different, less commonly sized or shaped packages, or a wider or narrower range of package sizes.

Figure 4:
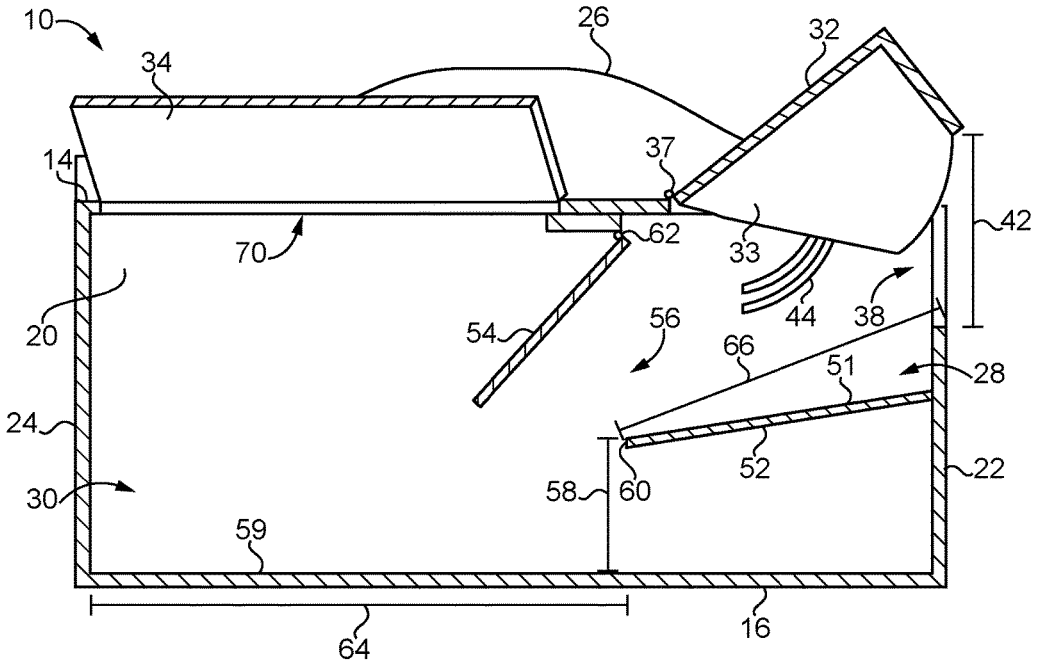
FIG. 4 is a partially sectioned diagrammatic view of a device for receiving packages, according to one embodiment.
Figure 5:
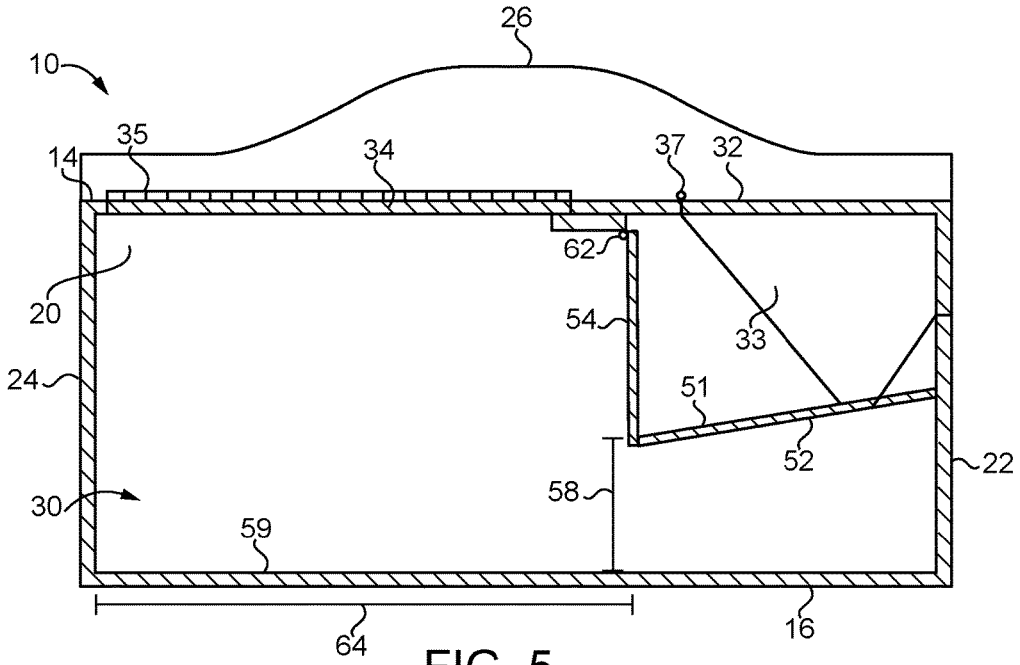
FIG. 5 is a partially sectioned diagrammatic view of a device for receiving packages, according to one embodiment.

Referring now also to FIGS. 4 and 5, partially sectioned views of device 10 are shown with hatches 32, 34 in the open and closed positions, respectively. Package opening 38 opens to receiving conduit 28, which is structured to receive packages deposited in device 10. Receiving conduit 28 has a floor 51 formed by a downwardly sloping chute ("chute") 52, and is typically also defined in part by package hatch 32 and body 12. Receiving conduit 28 extends between package opening 38 and a second chamber opening 56 that is formed at least in part by an edge 60 of chute 52. Second chamber opening 56 provides access to storage chamber 30. In this way, receiving conduit 28 opens into storage chamber 30 to allow for depositing of packages therein. Chute 52 is substantially planar and is angled toward storage chamber 30 to facilitate gravity feeding of packages towards storage chamber 30, although, in some embodiments, chute 52 might be contoured or have a different structure, or might include other structures or features to facilitate the conveying of packages from receiving conduit 28 to storage chamber 30. For example, chute 52 may have a coating or surface that limits frictional forces opposing sliding, or may include a conveyor of any suitable type. Receiving conduit 28 has a depth dimension 66 defined as a minimum distance between package opening 38 and edge 60. Depth dimension 66 may be understood as the minimum distance a thief would have to reach if attempting to access a package located within storage chamber 30. In a practical implementation strategy, chute 52 is sized and positioned within body 12 such that depth dimension 66 is not less than the average adult's arm length from armpit to wrist, which is believed to be approximately 19 inches. As such, depth dimension 66 might be about 19 inches or greater. In other embodiments, depth dimension may be longer if, for instance, it would be desirable to make device 10 more secure, or could be shorter if, for instance, a smaller form factor for device 10 is desirable.

Device 10 includes a second chamber hatch 54 pivotally coupled with top side 14 in a manner that allows second chamber hatch 54 to be freely movable between an open position and a closed position that blocks second chamber opening 56. Second chamber hatch 54 may be coupled with top side 14 by a second chamber hinge 62 that defines an axis of rotation of second chamber hatch 54. Hinges 37, 62 may be substantially parallel and each structured such that package hatch 32 and second chamber hatch 54 open in opposite directions. Second chamber hatch 54 may be drawn by the force of gravity towards edge 60 and may come to a rest thereon in the closed position, although second chamber hatch 54 might come to rest on a stopper, padding, or analogous structure in some embodiments. In other words, in the closed position, second chamber hatch 54 is typically in contact with chute 52 or a structured attached to chute 52. As can be seen in FIGS. 4 and 5, coupling second chamber hatch 54 with top side 14 may include attaching second chamber hinge 62 to a block or other structure that is then attached to top side 14. The open position of second chamber hatch 54 may therefore include pivoting second chamber hatch 54 into storage chamber 30, although second chamber hatch 54 might also be able to swing in to receiving conduit 28 in some embodiments.

Second chamber hatch 54 can be formed of any rigid or semi-rigid material or combination of materials and is typically opaque so as to obstruct a line of sight between package opening 38 and storage chamber 30. Second chamber hinge 62 may be structured to allow second chamber hatch 54 to open in response to application of only minimal force such that packages passing through receiving conduit 28 and engaging second chamber hatch 54 can pass into storage chamber 30 relatively easily. In other embodiments, it may be desirable to require a greater application of force to open second chamber hatch 54, however. In still other embodiments, second chamber hatch 54 and second chamber hinge 62 could function, in whole or in part, through operation of additional structures or forces. For instance, second chamber hatch 54 may be hydraulically, pneumatically, electrically, magnetically, or mechanically actuated in response to data indicative of a package being received by receiving conduit 28 or indicative of a package engaging second chamber hatch 54, or second chamber hatch 54 may include springs, weights, or any other suitable mechanism.

Second chamber opening 56 may be structured to correspond with the structure of package opening 38 such that packages deposited into receiving conduit 28 can pass into storage chamber 30. For example, second chamber opening 56 may have a height that is substantially equal to or greater than height 42. In this way, packages deposited into package opening 38 are likely to fit through second chamber opening 56 as well. Further, it will be appreciated that the structure of openings 38, 56, chute 52, and hinges 37, 62 may also allow device 10 to receive packages having a length, width, height, or other dimension greater than depth dimension 66, as any such package could be jointly received by package opening 38, receiving conduit 28, and second chamber opening 56. Put differently, the size of packages device 10 may be capable of receiving is not necessarily limited by the size of receiving conduit 28.

Chute 52 can be positioned within device 10 such that a vertical distance 58 between edge 60 and a floor 59 of storage chamber 30 corresponds with height 42 such that packages deposited in storage chamber 30 might not interfere with the movement of second chamber hatch 54. In other words, vertical distance 58 may be greater than a typical height of delivered packages. It will be appreciated that the relative dimensions of height 42 and vertical distance 58 may also function to limit the distance that packages might fall within device 10.

Referring now to FIGS. 1-5 generally, it can be seen that storage chamber 30 is entirely enclosed within body 12, and accessible only through first and second chamber openings 70, 56. Further, storage chamber 30 is positioned substantially lateral to receiving conduit 28 such that packages can be passed through body 12 in a substantially horizontal direction from package opening 38 to storage chamber 30. Storage chamber 30 has a chamber length 64 between edge 60 and left side 24, which may correspond with a maximum expected dimension of packages such that storage chamber 30 can receive packages having a length, width, height, or other dimension equal to or less than the maximum expected dimension. For example, in an exemplary embodiment, chamber length 64 may be about 48 inches or greater. In other embodiments, chamber length 64 may be selected to correspond with any other dimension or may be selected in consideration of any other desired characteristic or parameter. For example, some embodiments of device 10 may be structured to fit in a confined space, in which case it may be desirable for device to have a chamber length 64 that is less than an expected or potential maximum package dimension.

To secure a package within device 10, a courier or other party can open package hatch 32 and insert the package therein. The package is then received by receiving conduit 28, and may be drawn under the force of gravity towards second chamber opening 56 by, for example, sliding down chute 52, although the courier could also push the package down chute 52 towards or into storage chamber 30. At second chamber opening 56, the package can engage second chamber hatch 54, which is structured to open in the direction of storage chamber 30, thereby permitting the package to slide into storage chamber 30 where it may come to rest on floor 59 or perhaps on another package. Second chamber hatch 54 can then be drawn under the force of gravity back to the closed position, thereby blocking a line of sight into storage chamber 30.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. As noted above, the teachings set forth herein are applicable to a variety of different devices having a variety of different structures than those specifically described herein. Other aspects, features and advantages will be apparent upon an examination of the attached drawings and appended claims. As used herein, the articles "a" and "an" are intended to include one or more items, and may be used interchangeably with "at least one." Where only one item is intended, the term "one" or similar language is used. Also, as used herein, the terms "has," "have," "having," or the like are intended to be open-ended terms.

The invention claimed is:

1. A device for receiving packages comprising:

a body including a top side having a package hatch movable to open or close a package opening, a storage chamber having a chamber opening, and a receiving conduit extending between the storage chamber and the package opening, the storage chamber and the receiving conduit each being partially formed by the top side;

a chamber hatch coupled with the top side that blocks the chamber opening;

a downward sloping chute forming a floor of the receiving conduit for conveying packages to the storage chamber under the force of gravity; and a package hinge coupling the package hatch with the top side, and a chamber hinge coupling the chamber hatch with the top side such that the chamber hatch is drawn under the force of gravity towards an edge of the downward sloping chute.

2. The device of claim 1 wherein the chamber opening and the package opening are structured to jointly receive a package having a length greater than a length of the receiving conduit.

3. The device of claim 2 wherein the package hatch is movable around an axis of rotation defined by the package hinge, and the chamber hatch is movable around an axis of rotation defined by the chamber hinge, the package hatch and the chamber hatch opening in opposite directions.

4. The device of claim 3 wherein the package hinge and the chamber hinge are substantially parallel.

5. The device of claim 1 wherein a minimum distance between the package opening and an edge of the downward sloping chute is less than a chamber length of the storage chamber from the edge to a wall of the storage chamber opposite the edge.

6. The device of claim 5 wherein the minimum distance between the package opening and the edge of the downward sloping chute is about 19 inches or greater.

7. The device of claim 5 wherein the storage chamber length is about 38 inches or greater.

8. The device of claim 1 wherein a vertical distance between an edge of the downward sloping chute and a floor of the storage chamber is not more than twice a height of the package opening.

9. The device of claim 1 wherein the body further includes a back piece at least partially positioned above and oriented substantially perpendicular to the top side.

10. A The device of claim 1 for receiving packages comprising:

a body including a top side having a package hatch movable to open or close a package opening, a storage chamber having a chamber opening, and a receiving conduit extending between the storage chamber and the package opening, the storage chamber and the receiving conduit each being partially formed by the top side;

a chamber hatch coupled with the top side that blocks the chamber opening; and a downward sloping chute forming a floor of the receiving conduit for conveying packages to the storage chamber under the force of gravity;

wherein the storage chamber has a second chamber opening and the device further includes a second chamber hatch blocking the second chamber opening.

11. The device of claim 10 further including a single lock, the single lock being structured to engage the second chamber hatch such that access to the second chamber opening can be restricted.

12. A bench for receiving packages comprising:

a body including a receiving conduit, a storage chamber having a first chamber opening and a second chamber opening, and a plurality of sides, including a top side;

a package hatch movable between an open position and a closed position blocking a package opening;

a downward sloping chute forming a floor of the receiving conduit, the receiving conduit extending between the package opening and the second chamber opening;

a first chamber hatch coupled with the top side and movable between an open position and a closed position blocking the first chamber opening; and a second chamber hatch coupled with the top side and movable between an open position and a closed position blocking a line of sight between the package opening and the storage chamber.

13. The bench of claim 12 wherein the second chamber hatch is in contact with the downward sloping chute in the closed position, the second chamber hatch being coupled with the top side such that the second chamber hatch is drawn under the force of gravity towards the downward sloping chute.

14. The bench of claim 12 wherein the package hatch is movable around a first axis defined by a package hinge, and the second chamber hatch is movable around a second axis defined by a chamber hinge, the first axis and the second axis being substantially parallel.

15. The bench of claim 14 wherein the package hatch and the second chamber hatch open in opposite directions.

16. The bench of claim 12 further including a slide assembly coupling the package hatch with the body to limit a height of the package opening.

17. The bench of claim 12 further including a side guard attached to the package hatch.

18. The device of claim 12 wherein the downward sloping chute is substantially planar.

19. A device for securing package deliveries comprising:

a body including a plurality of sides arranged in a box configuration, the plurality of sides including a top side;

a storage chamber having a first chamber opening formed in the top side and a second chamber opening;

a first chamber hatch coupled with the top side, and movable between an open position and a closed position blocking the first chamber opening;

a second chamber hatch coupled with the top side, and movable between an open position and a closed position blocking the second chamber opening;

a receiving conduit extending between the second chamber opening and a package opening formed in the top side;

a package hatch coupled with the top side, and movable between an open position and a closed position blocking the package opening; and a downward sloping chute partially forming a floor of the receiving conduit to facilitate conveying packages from the receiving conduit to the storage chamber.

* * * * *